United States Patent [19]

Dreier et al.

[11] Patent Number: 4,463,693

[45] Date of Patent: Aug. 7, 1984

[54] CUTTING ATTACHMENT FOR A SEWING MACHINE

[75] Inventors: Ernst Dreier, Steckborn; Jakob Rickenbach, Kreuzlingen, both of Switzerland

[73] Assignee: Fritz Gegauf Bernina Sewing Machine Manufacturers Limited, Steckborn, Switzerland

[21] Appl. No.: 525,224

[22] Filed: Aug. 22, 1983

[30] Foreign Application Priority Data

Sep. 15, 1982 [CH] Switzerland ..... 5453/82

[51] Int. Cl.[3] ..... D05B 65/02; D05B 37/06

[52] U.S. Cl. ..... 112/128

[58] Field of Search ..... 112/128

[56] References Cited

U.S. PATENT DOCUMENTS 947,506 1/1910 Weinbach et al. ..... 112/128

2,443,369 6/1948 Alifano et al. ..... 112/128

4,389,952 6/1983 Dreier et al. ..... 112/128

*Primary Examiner*—Werner H. Schroeder

*Assistant Examiner*—Andrew M. Falik

*Attorney, Agent, or Firm*—Werner W. Kleeman

[57] ABSTRACT

An attachment for cutting the edge of a length of material travelling towards a sewing location is mounted on the working or operating surface of a sewing machine. A drive fork is acted upon by a needle bar and drives a movable cutter blade via a drive or control cam carrier. The movable cutter blade is arranged at a blade holder which is pivotable about a pivot axis which is laterally spaced from a cutting plane defined by the movable cutter blade and a fixed cutter blade. A large through-passage or space for strips separated from the length of material by the cutter blades is formed between the cutting plane and the blade holder.

5 Claims, 4 Drawing Figures

CUTTING ATTACHMENT FOR A SEWING MACHINE

BACKGROUND OF THE INVENTION

The present invention relates to a new and improved attachment for use with a sewing machine for cutting the edges of a length of material fed to the sewing machine.

In its more specific aspects the invention relates to a new and improved cutting attachment for use with a sewing machine for cutting edges of a length of material fed to the sewing machine, said cutting attachment comprising a fixed or stationary cutter blade and a movable cutter blade drivable by means of a needle bar of the sewing machine via an articulated lever mechanism, the movable cutter blade coacting with the fixed cutter blade in the manner of a pair of scissors.

Such cutting attachments can be affixed to all types of sewing machines and various designs thereof are known for cutting the edge of the fabric material to be sewn travelling towards the sewing location. Usually the movable cutter blade driven by the needle bar is substantially vertically moved and cooperates with a counter cutter blade which is fixedly connected to a part of the sewing machine. In such an arrangement as known, for example, from Italian Pat. No. 603,617, the movable cutter blade is either directly mounted at the needle bar or at a cutter blade holder mounted on the working or operating surface of the sewing machine. In another construction of cutting attachment, as known for example, from German patent publication No. 3,122,935, either an appropriately constructed edge of the sewing foot, a cutting edge mounted thereto, or a counter cutter blade supported by the cutting attachment serves as the fixed cutter blade or counter blade.

The known cutting attachments either are complicated or cumbersome to handle in that parts of the sewing machine have to be exchanged or adjusting operations are required in order to ensure accurate cooperation of the two cutter blades. In the case of the cutting attachment according to the already mentioned German patent publication No. 3,122,935, the sewing foot has to be exchanged for the cutting attachment. Directly mounting the cutting attachment to the presser bar has the disadvantage that the cutting attachment is lifted together with the presser when thick sewing material is to be stitched and cut, so that the infeed of the sewing material and the simultaneous stitching around the edge of the material at the very least is rendered more difficult if not made impossible. Furthermore, the axis of the movable cutter blade is located directly at the cutting location and obstructs the removal of the separated or cut material. It is a further disadvantage of the known cutting attachment that the motion is transmitted through a number of hinges which, in addition to the resultant expensive manufacture, also leads to undesired wear, play and noise.

SUMMARY OF THE INVENTION

Therefore, with the foregoing in mind it is a primary object of the present invention to provide a new and improved cutting attachment for use with a sewing machine for cutting the edges of a length of material fed to the sewing machine, which is not afflicted with the aforementioned drawbacks and limitations heretofore discussed.

Another important object of the present invention is directed to the provision of a new and improved cutting attachment for use with a sewing machine for cutting the edges of a length of material fed to the sewing machine in which there are not present at the immediate region or vicinity of the two cutter blades any obstructing elements which would retard or obstruct the throughput of the material to be operated upon, particularly in case of medium to thick materials.

Still a further significant object of the present invention is directed to a new and improved cutting attachment for use with a sewing machine for cutting the edges of a length of material fed to the sewing machine which provides, at the immediate vicinity of the two cutter blades, for the cut off material a throughpassage or space which is sufficiently large and free of any obstructions which otherwise might cause an undesirable damming or back-up of the material when fed to the sewing machine, particularly in case of medium to thick materials.

Another noteworthy object of the present invention is directed to a new and improved construction of a cutting attachment for use with a sewing machine for cutting the edges of a length of material fed to the sewing machine, in which the requisite cutting force is transmitted as directly as possible from a drive member or element arranged at the needle bar to the movable cutter blade without employing any appreciable number of intermediate members.

Now in order to implement these and still further objects of the invention, which will become more readily apparent as the description proceeds, the cutting or cutter attachment of the present development is manifested by the features that, the articulated lever mechanism is constituted by a drive cam support or carrier comprising a drive or control fork and a cutter blade holder or support carrying the movable cutter blade and engaging the drive cam support or carrier. The drive cam support or carrier and the cutter blade holder are mounted for rotation about a first pivot shaft or axis and a second pivot shaft or axis, respectively, and the connection of the cutter blade holder to the second pivot shaft or axis is arranged at an axial offset outside a cutting plane defined by the two cutter blades with the formation of a throughpassage or space for the material sections cut-off from the length of material to be sewn.

The axial offset of the cutter blade holder and the driving members thereof relative to the cutting plane defined by the two cutter blades is particularly advantageous. There is thus provided an unobstructed throughpassage or space for the sections of material cut-off from the length of material fed to the sewing machine.

In a preferred construction of the cutting attachment according to the invention, the movable cutter blade possesses a substantially U-shaped construction containing a first leg from which the movable cutter blade projects downwardly and which coacts with the flat fixed counter cutter blade, a second leg connecting the movable cutter blade to the cutter blade holder, and a connecting member interconnecting the two legs or leg members, and thus, bridging the material throughpassage or space. Such a design has the great advantage that the space or region around the cutter blades remains unobstructed both laterally as well as above the same, whereby the throughflow of the length of material being processed is not obstructed. The free throughpassage or space should preferably laterally amount to about 20 mm and at least 8 mm in height. Usually all materials to be processed in a household or domestic sewing machine thus can be faultlessly cut.

In the cutting attachment according to the invention the movable cutter blade is driven from a drive member at the needle bar; usually this drive member forms part of the needle mount or holder. According to the invention, the drive member acts upon a single intermediate member which contains the control cam for controlling the movement of the movable cutter blade, and this intermediate member acts directly to drive the cutter blade holder. There is thus realized an arrangement which is extremely favorable with respect to costs, and the number of movable, force-transmitting members is thus reduced to an absolute minimum. Additionally, in a preferred design of the cutting attachment according to the invention, the cutter blade holder is constructed so as to be axially movable to a small extent and is pressed conjointly with the movable cutter blade towards the fixed counter cutter blade under the force of a spring. The two cutting edges are thus always located close to each other, which results in a self-grinding or sharpening action of the cutter blades during operation.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
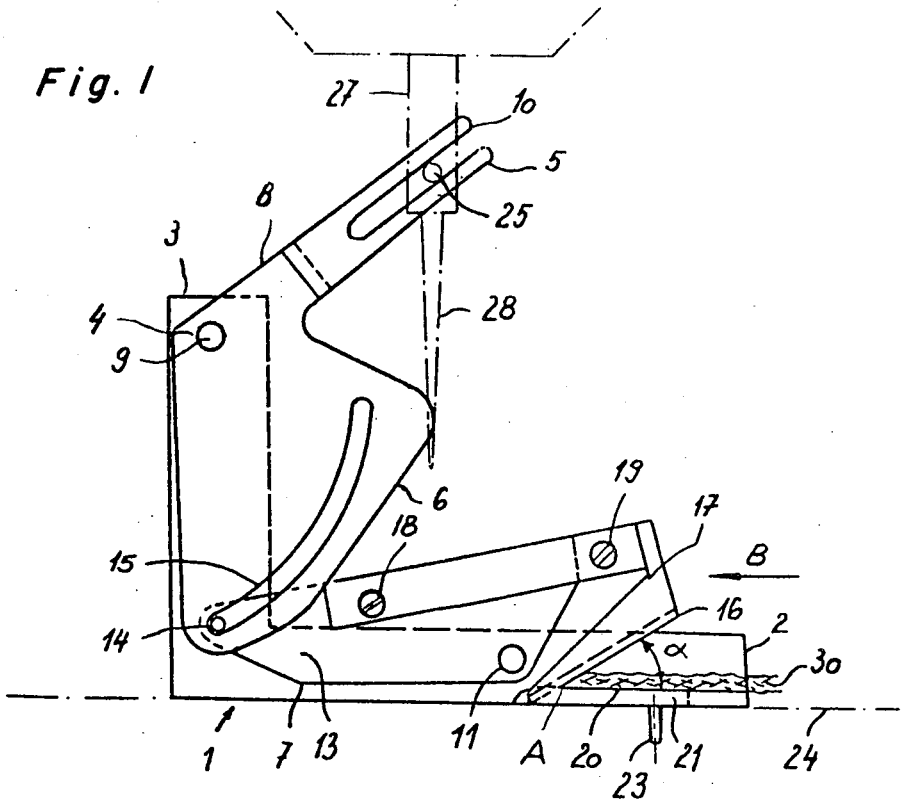
FIG. 1 is a side view of the cutting attachment according to the invention on the side of the needle with the needle in the raised position.

Describing now the drawings, it is to be understood that only enough of the construction of the cutting attachment has been shown as needed for those skilled in the art to readily understand the underlying principles and concepts of the present development, while simplifying the showing of the drawings. Turning attention now to the drawings, there has been illustrated a cutting attachment holder or support 1 containing a base plate 2 and an upright fixture 3. The cutting attachment holder 1 is provided with an articulated lever mechanism 4 comprising a drive fork or fork member 5, a drive cam support or carrier 6, and a cutter blade holder or support 7. Preferably, the drive fork 5 and the drive cam support or carrier 6 form an integral or one-piece drive member 8. The drive member 8 is pivotably connected with a pivot shaft 9, defining a pivot axis, in conventional manner at the upright fixture 3. The drive fork 5 which is part of the drive member 8, forms a slot-shaped or slotted opening 10 and is axially spaced from the drive cam support or carrier 6 which also forms a part of the drive member 8.

The cutter blade holder or support 7, which constitutes another member of the articulated lever mechanism 4, is pivotably linked via a pivot pin or axial bolt 11 or equivalent structure to the base plate 2 and also is axially displaceable to a small extent. The cutter blade holder 7 is journalled to pivot about a second pivot axis defined by the pivot pin 11. A bore 11*a* for the pivot pin 11 is provided in the base plate 2. The cutter blade holder 7 defines a free end 13 and close to such free end 13 there is mounted a guide pin 14 at the cutter blade holder 7. The guide pin 14 engages a cam track or camming structure 15 formed in the drive cam support or carrier 6. A spring 12 surrounding the end of the pivot pin or bolt 11 which protrudes from the upright fixture 3 is provided between the cutter blade holder 7 and the upright fixture 3 for the purpose to be described hereinafter.

The movable cutter blade 17 is of a substantially U-shaped design and comprises a first leg or leg member 31 to which a cutting knife 16 is mounted so as to protrude downwardly. A second leg or leg member 32 thereof serves to connect the movable cutter blade 17 to the cutter blade holder 7 by means of threaded bolts or screws 18, 19, one of which may be eccentrically designed so as to enable the movable cutter blade 17 to be adjusted relative to the cutter blade holder 7. The two legs or leg member 31, 32 are interconnected by a self-supporting connection member 33 which extends at a distance from the base plate 2 to form a material throughpassage or space 34. A fixed cutter blade 21, defining a counter cutter blade, forms a flat part of only a few millimeters height which laterally juts out from the base plate 2 and contains a cutting knife or edge 20.

It will be seen that the connection member 33 also holds the first leg 31 spaced from the cutter blade holder 7; in fact the movable cutter blade 17 and the fixed cutter blade 21 are arranged in such a way as to define a cutting plane. The spring 12 arranged between the base plate 2 and the cutter blade holder 7 causes the cutting knife or edge 16 of the movable cutter blade 17 to elastically resiliently engage the cutting knife or edge 20 of the fixed cutter blade 21 provided at the base plate 2.

The base plate 2 of the cutting attachment holder or support 1 is intended to be mounted at the working or operating surface 24 of a sewing machine. Therefore, the base plate 2 is provided with a knurled head bolt or screw 22 and a centering pin 23 for fixing the base plate 2 to such working or operating surface 24 of the sewing machine.

In the mounted state of the cutting attachment holder 1 to the working or operating surface 24 of the sewing machine, the slot-like opening 10 of the drive fork 5 is in engagement with a clamping bolt 25 or equivalent structure which is arranged at the needle bar 27 of the sewing machine and usually forms part of a needle mount or holder.

Figure 3:
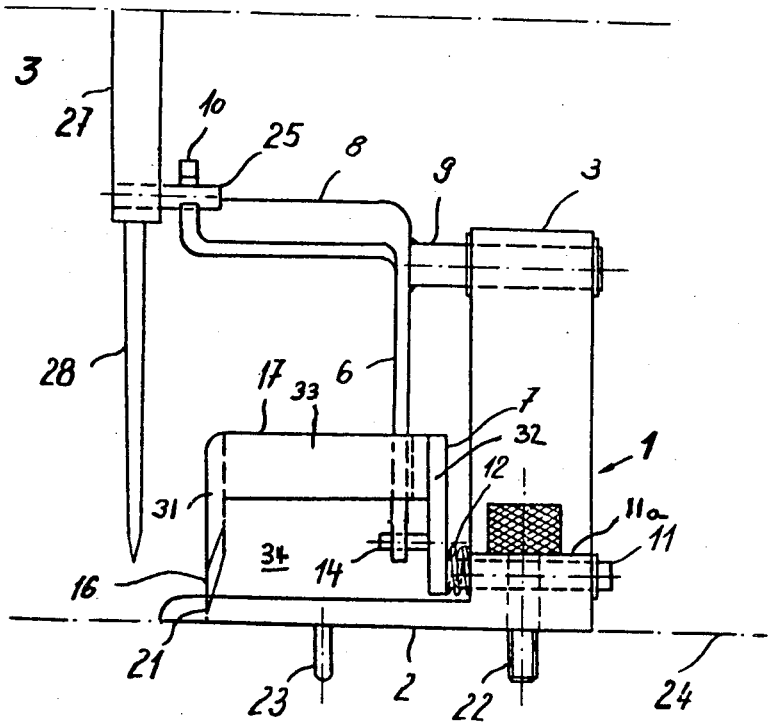
FIG. 3 is a front view of the cutting attachment shown in FIG. 1.
Figure 4:
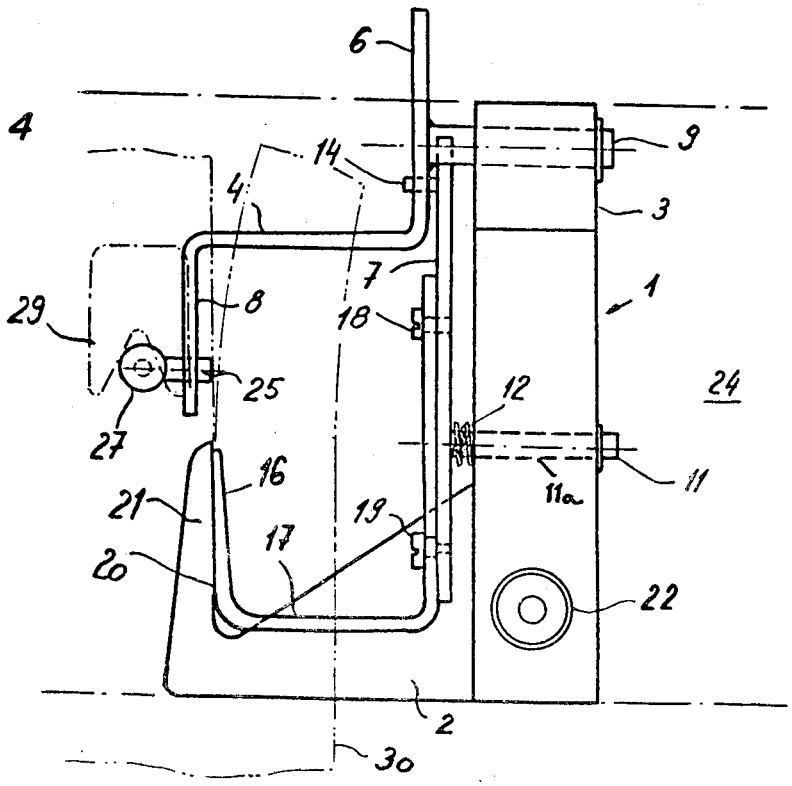
FIG. 4 is a top plan view of the cutting attachment shown in FIG. 1.

When the needle 28 is moved conjointly with the needle bar 27 into its upper position, the movable cutter blade 17 is also raised by means of the guide pin 14 which engages the cam track 15. The movable cutter blade 17 and the fixed cutter blade 21 are then located opposite one another and form an opening angle $\alpha$. In this position the edges of the movable cutter blade 17 and the fixed cutter blade 21 cross or intersect at the point A on the side facing the needle 28, as best seen in FIGS. 1 and 3.

Figure 2:
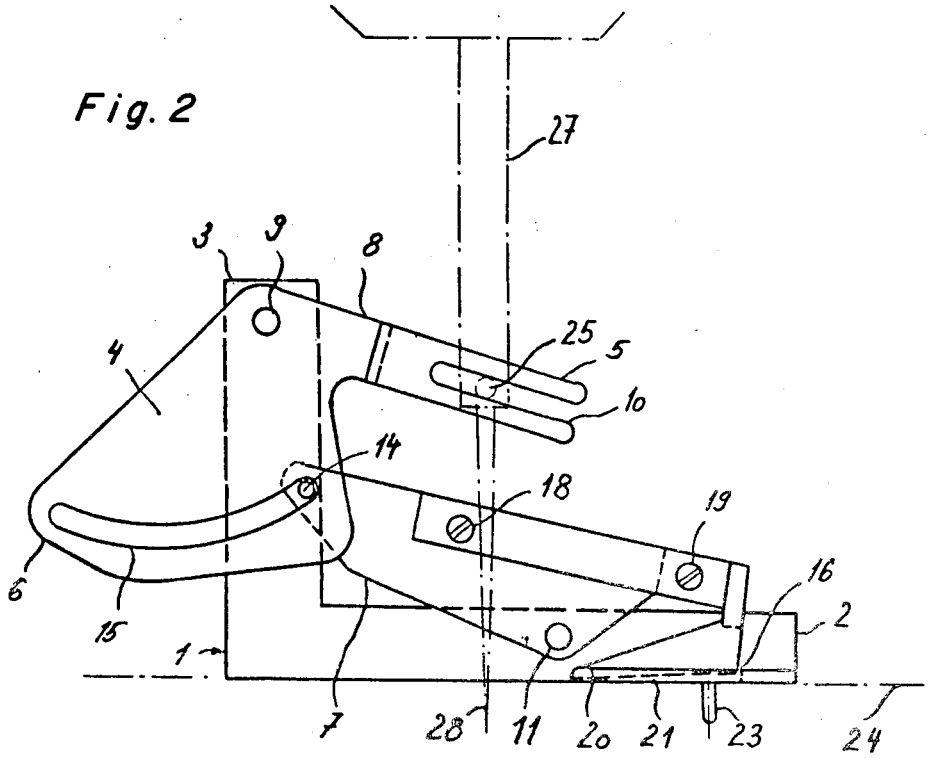
FIG. 2 is a side view of the cutting attachment shown in FIG. 1 with the needle in a lowered position.

When the needle 28 is lowered, the movable cutter blade 17 is driven by the engagement of the guide pin or cam follower 14 with the cam track 15 and engages the fixed cutter blade 22 over its entire length; in this position of the needle 28 the movable cutter blade 17 extends substantially parallel to the fixed cutter blade 21, as shown in FIG. 2.

The cutting attachment as described hereinbefore operates as follows:

The cutting attachment holder 1 is mounted in standardized threaded bores in the working or operating surface 24 of the sewing machine by means of the threaded bolt 22 and the centering pin 23 or equivalent structure. During this operation the clamping bolt 25 or the like at the needle bar 27 engages the slot-like or slotted opening 10 of the drive fork 5. In case that the needle 28 is its raised position, the movable cutter blade 17 and the fixed cutter blade 21 are then arranged to form a maximum opening angle $\alpha$ with respect to each other. No further changes have to be made at the sewing machine.

In the position as shown in FIG. 1 a length of material 30 to be operated upon or processed by the sewing machine is introduced into the opening angle $\alpha$ formed by the movable cutter blade 17 and the fixed cutter blade 21 and the sewing machine is started. When the needle 28 is lowered, the drive fork or fork member 5 and conjointly therewith the drive cam support or carrier 6 are rotated about the first pivot axis defined by the pivot pin 9. The guiding or guide pin 14 is guided by the arc-shaped cam track 15 and rotates the cutter blade holder 7 about the second pivot axis defined by the pivot pin 11. During this operation the cutting edge of the movable cutter blade 17 mounted to the cutter blade holder 7 slides past the cutting edge 20 of the fixed cutter blade 21 and cuts the material 30 located in the opening region of the movable cutter blade 17 and the fixed cutter blade 21, while the sewing machine tools form a stitch of an edge seam, as depicted in FIG. 2.

When the movement of the needle bar 27 is reversed, the needle 28 is withdrawn from the length of material 30 and the movable cutter blade 17 is raised. As soon as the needle 28 is located at its upper region, the length of material 30 below the presser 29 is pushed-on or advanced by the length of one stitch in the direction of the arrow B by the feeder (not shown) of the sewing machine. A new and uncut section of the length of material 30 is thus pushed into the working or effective region of the movable cutter blade 17 and the fixed cutter blade 21, which are now reopened due to the action of the articulated lever mechanism 4.

The throughpassage or space 34 permits the material strip cut-off from the length of material to unobstructedly move when the feeder is actuated.

By virtue of the construction and configuration of the cam track 15 the time course as well as the cutting speed can be determined and controlled.

While there are shown and described present preferred embodiments of the invention, it is to be distinctly understood that the invention is not limited thereto, but may be otherwise variously embodied and practiced within the scope of the following claims. Accordingly,

What we claim is:

1. A cutting attachment for use with a sewing machine for cutting the edges of a length of material fed to the sewing machine, said sewing machine containing a needle bar, which cutting attachment comprises:

a fixed cutter blade;

a movable cutter blade driveable by said needle bar;

said movable cutter blade coacting with said fixed cutter blade in the manner of a pair of scissors;

said movable cutter blade and said fixed cutter blade conjointly defining a cutting plane;

an articulated lever mechanism drivingly interconnecting said needle bar and said movable cutter blade;

said articulated lever mechanism comprising:

a control cam carrier containing a drive fork;

means mounting said control cam carrier to be pivotable about a first pivot axis;

a cutter blade holder supporting said movable cutter blade; and means mounting said cutter blade holder to be pivotable about a second pivot axis;

means operatively connecting said cutter blade holder with said control cam carrier;

said cutter blade holder being connected with said pivotable mounting means of said cutter blade holder so as to be arranged at an axial offset outside said cutting plane while forming a throughpassage to accommodate a section of material cut-off from said length of material.

2. The cutting attachment as defined in claim 1, wherein:

said needle bar contains a needle bar clamping bolt; and said articulated lever mechanism is drivingly connected to said needle bar clamping bolt.

3. The cutting attachment as defined in claim 1, wherein:

said movable cutter blade possesses a substantially U-shaped configuration comprising a first leg, a second leg and a self-supporting connection member;

said first leg forming a cutting knife of said movable cutter blade;

said second leg connecting said movable cutter blade with said cutter blade holder;

said cutter blade holder defining a plane; and said connection member holding said first leg spaced from said plane of said cutter blade holder.

4. The cutting attachment as defined in claim 1, further including:

means for adjustably mounting said movable cutter blade at said cutter blade holder.

5. The cutting attachment as defined in claim 1, wherein:

said fixed cutter blade forms a cutting edge; and means for resiliently biasing said movable cutter blade together with said cutter blade holder towards said cutting edge of said fixed cutter blade.

* * * * *